United States Patent [19]

Giannini

[11] 4,027,278

[45] May 31, 1977

[54] SEALED PERMANENT MAGNET SWITCH

[76] Inventor: Gabriel M. Giannini, 79-811 Avenue 54, Indio, Calif. 92201

[22] Filed: May 27, 1975

[21] Appl. No.: 591,015

[52] U.S. Cl. ..... 335/154; 335/187; 335/207

[51] Int. Cl.[2] ..... H01H 1/66

[58] Field of Search ..... 335/151, 153, 154, 205, 335/207, 187, 188, 206

[56] References Cited

UNITED STATES PATENTS

| | | | |
|---|---|---|---|
| 2,498,683 | 2/1950 | Hubbell | 335/207 X |
| 3,025,372 | 3/1962 | Benson | 335/207 |
| 3,052,778 | 9/1962 | Kathe | 335/207 |
| 3,325,756 | 6/1967 | Maxwell | 335/207 X |
| 3,601,727 | 8/1971 | Hults | 335/188 X |

OTHER PUBLICATIONS

Giannini Custom Switches, brochure & sample switches distributed prior to June 27, 1974.

*Primary Examiner*—George Harris
*Attorney, Agent, or Firm*—Fraser and Bogucki

[57] ABSTRACT

A sealed switch includes C-shaped control and follower magnets disposed along an axis with poles thereof in facing relationship, a set of electrical switch contacts coupled to be selectively opened or closed in dependence upon the position of the follower magnet, and a housing enclosing the set of electrical contacts and the follower magnet, the housing having a nonmagnetic wall extending between the facing poles of the control and follower magnets to provide hermetic isolation of the contacts. In accordance with particularly selected configurations, the control magnet may be mounted for alternatively pushbutton type axial motion or rotational motion within different selected limits and the follower magnet may be mounted for either axial or rotational motion within predetermined limits or both. The magnets may be resiliently biased toward predetermined position limits in some configurations. Regardless of the selected configuration, the contacts remain completely enclosed by the housing to be selectively opened or closed by the follower magnet in response to the positioning of the control magnet.

18 Claims, 12 Drawing Figures

CONTROL ELEMENT 12
FOLLOWER ELEMENT 14

FIG. 2
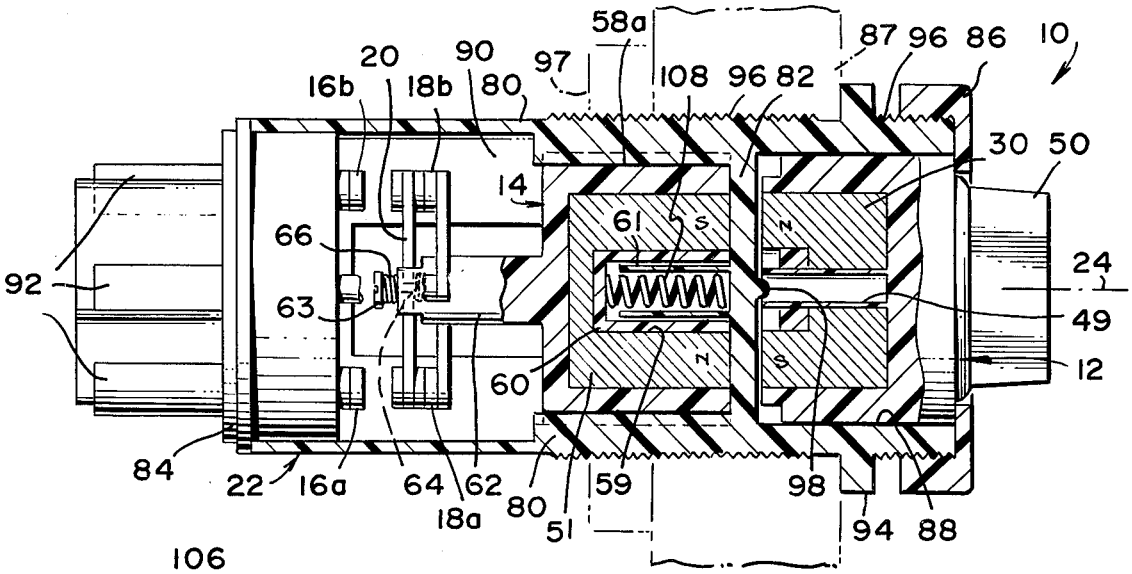
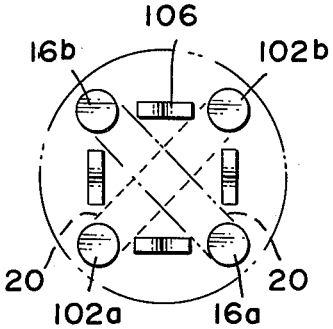
FIG. 6
FIG. 5
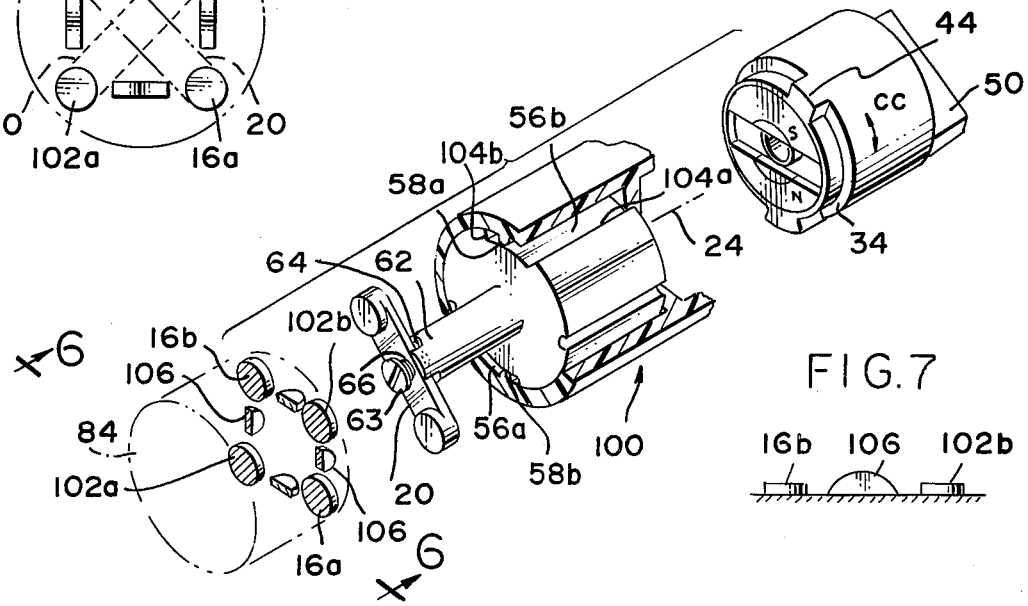
FIG. 7
FIG. 8
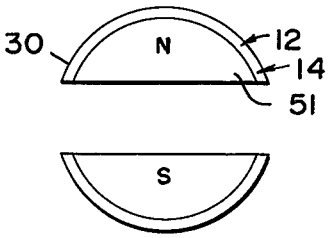
FIG. 9
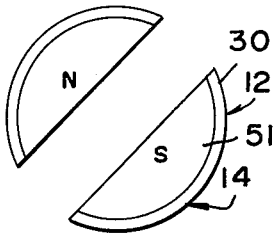
FIG. 10
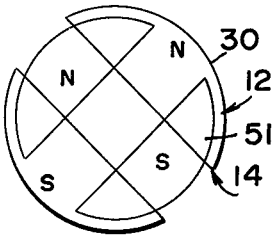

SEALED PERMANENT MAGNET SWITCH

CROSS REFERENCE TO RELATED APPLICATIONS

This application is related to simultaneously filed application, "Sealed Permanent Magnet Switch", Ser. No. 591,014, by Gabriel M. Giannini.

BACKGROUND OF THE INVENTION

1. Field of the Invention

This invention relates to electrical switches and more particularly to hermetically sealed switches with magnetic coupling between switch contacts and control levers.

2. Description of the Prior Art

Sealed, explosion proof switches are commonly used in special environments such as an explosive atmosphere wherein it is desirable to completely isolate switch contacts. This isolation protects the environment from any sparks that may be generated during switching and also protects the switching mechanism from the environment. In one arrangement of a sealed magnetic switch an outer follower magnet which makes electrical contacts is disposed in a chamber concentrically about a central, similarly poled control magnet. Selective axial positioning of the control magnet, in combination with repulsive forces of the control magnet and concentric follower magnet causes the follower magnet to move axially between first and second limits in accordance with the repulsive forces of the control magnet. In another arrangement, control and follower magnets are disposed side by side in similar mating pole relationship with repulsive forces therebetween inducing axial motion in the follower magnet in response to motion of the control magnet along a parallel axis to maintain the control and follower magnets at opposite limits of restricted travel paths. In other arrangements, moving seals between control and follower magnets defeat the goal of complete isolation. Such prior art arrangements are unable to provide the economy and flexibility of sealed switches in accordance with the invention while maintaining complete isolation of the electrical switching contacts.

SUMMARY OF THE INVENTION

A magnetically controlled switch in accordance with the invention which provides completely sealed switching contacts includes a first or control magnet and a second or follower magnet disposed along an axis with pole faces in spaced-apart opposed relationship, a set of electrical contacts which is selectively opened and closed in response to positioning of the follower magnet, and a housing which sealingly encloses the electrical contacts and follower magnet. The housing has a non-magnetic wall which extends generally perpendicular to the axis and is disposed between the opposed pole faces of the opposed control and follower magnets. The follower magnet includes a conductive path coupled for motion therewith which is operable to selectively open and close at least one pair of electrical contacts in response to predetermined positioning of the follower magnet.

Sealed switches in accordance with the invention may assume any of a number of specific configurations. In one configuration the control magnet is constrained to rotate between first and second predetermined angular limits at a fixed axial position. The follower magnet may be constrained to limited axial translation at a fixed rotational position. As the control magnet rotates facing magnet poles of the control and follower magnets come into opposing alignment with alternately similar and opposite polarities causing the follower magnet to translate between spaced-apart and proximate positions relative to the control magnet under control of the alternately repulsive and attractive forces respectively between the two magnets. One or more pairs of contacts may be positioned relative to the follower magnet to permit the contacts to be selectively closed by the conductive path when the follower magnet is at one or the other of two limits of translational motion.

In another arrangement wherein the control magnet is constrained to rotation between predetermined limits, the follower magnet is also constrained to rotation between predetermined limits at a fixed axial position proximate the control magnet. The magnets are arranged for alignment of similar poles in opposed relationship (magnetic repulsion) when both the control and follower magnets are oriented at the approximate midpoint of their limited angles of rotation. With the angle of rotation for the follower magnet being selected to be less than the angle of rotation of the control magnet, continued rotation of the control magnet beyond a follower magnet limit causes repulsive forces to be developed between the two magnets and forces the follower magnet to be rotated to one limit as the control magnet is rotated to a limit opposite thereto. A conductive path is disposed for rotation with the follower magnet to selectively close at least one pair of contacts when the follower magnet is at a rotational limit.

In still another arrangement, the control magnet is permitted to rotate through an included angle much greater than the included angle of rotation for the follower magnet. A selected switch configuration such as a two circuit alternate single throw double break switch is attained by permitting the follower magnet to both rotate through relatively small angular limits and translate axially. A first pair of contacts is disposed to be closed by a conductive path coupled to the follower magnet when the follower magnet is at a first rotational limit in an axially spaced position and a second pair of contacts is disposed to be closed when the follower magnet is at the opposite rotational limit at an axially spaced position. The magnetic poles are arranged for magnetic attraction when both the control and follower magnets are at the approximate mid-point of their respective limited angular rotations. Under this circumstance the follower magnet is attracted to a proximate position relative to the control magnet and both pairs of contacts are opened. As the control magnet rotates in one direction the follower magnet rotates with the control magnet until a limit of the follower magnet is reached at which the conductive path is disposed in alignment with, but spaced apart from, a first pair of electrical contacts. As the control magnet continues to rotate beyond the limit of the follower magnet a point is reached where the active magnetic forces between the two magnets become repulsive in the axial direction while remaining attractive in the rotational direction. At this point the follower magnet translates axially while remaining at the rotational limit to a spaced-apart position to close one set of electrical contacts. The follower magnet may be resiliently biased by a spring mechanism toward a spaced-apart position to increase the switch contact closure force and decrease the angle through which the control magnet must continue to rotate beyond a rotational limit of the follower magnet before the follower magnet translates to a spaced-apart position. Rotation of the control magnet in the opposite direction causes the follower magnet to rotate to the opposite limit of rotation while being attracted to the control magnet and to close a different set of electrical contacts which are in alignment with the electrical path when the follower magnet is at the opposite rotational limit. Alternatively, the switch may be configured as a double throw single break switch or a double throw double break switch. Also, switch contacts might be provided for closure when the follower element is at a proximate position.

In still another arrangement translational motion of the control magnet may be permitted with both the control and follower magnets being resiliently biased toward spaced-apart positions. A first pair of contacts may be disposed for closure by a conductive path coupled to the follower magnet, which is not permitted to rotate, when the follower magnet is at a proximate position. Spring and magnetic forces are advantageously selected in conjunction with the axial translational travel limits to create a relationship in which the control magnet will always move toward a spaced-apart position in the absence of an external force and the follower magnet will always assume a spaced-apart position when the control magnet is at a spaced-apart position and will always assume a proximate position when the control magnet is at a proximate position. Placement of electrical contacts such that a conductive path traveling with the follower magnet closes the contacts when the follower magnet is at a proximate position results in a single pole, single throw, double break, normally open pushbutton switch. Electrical switching variations may be attained by selectively placing electrical contacts for closure by the conductive path when the follower magnet is at a spaced position either in addition to or instead of the normally open switch contacts.

The various switch configurations may be advantageously assembled from universal switch components including a generally cylindrical control magnet element having a plurality of circumferentially extending grooves of different lengths, a generally cylindrical follower magnet element having axially extending grooves of different circumferential lengths in the periphery thereof, and a housing element having generally cylindrical control and follower chambers separated by a thin, nonmagnetic wall for receiving control and follower elements respectively. The control chamber includes a tab for engagement of a selected circumferential control element groove to limit control element rotational freedom in accordance with the manner of assembly. The follower chamber is sealed and includes an axially extending tab receiving an axial follower element groove for selectively limiting rotational freedom of a follower element. Selection of a switch contact configuration, in conjunction with selective assembly of switch components, thus permits use of the same components for a variety of sealed switch configurations.

BRIEF DESCRIPTION OF THE DRAWINGS

A better understanding of the invention may be had from a consideration of the following detailed description taken in conjunction with the accompanying drawings, in which:

FIG. 2 is a sectional view, taken along a diametric plane, of the switch shown in FIG. 1;

FIG. 5 is a perspective view, partly broken away, of an alternative arrangement of a sealed magnetic switch in accordance with the invention;

FIG. 6 is a diagrammatic representation of switch contacts for the switch shown in FIG. 5 viewed along the plane 6—6 as shown therein;

FIG. 7 is an enlarged, fragmentary top view of the switch contacts shown in FIG. 5;

FIG. 8 is a diagrammatic illustration of magnetic orientations which is useful in understanding the operation of the switch shown in FIG. 5;

FIG. 9 is a diagrammatic representation of magnetic switch orientation which is useful in understanding the operation of the switch shown in FIG. 5;

FIG. 10 is a diagrammatic illustration of magnetic orientations useful in understanding the operation of the switch shown in FIG. 5;

DETAILED DESCRIPTION

Figures 1, 3, 4:
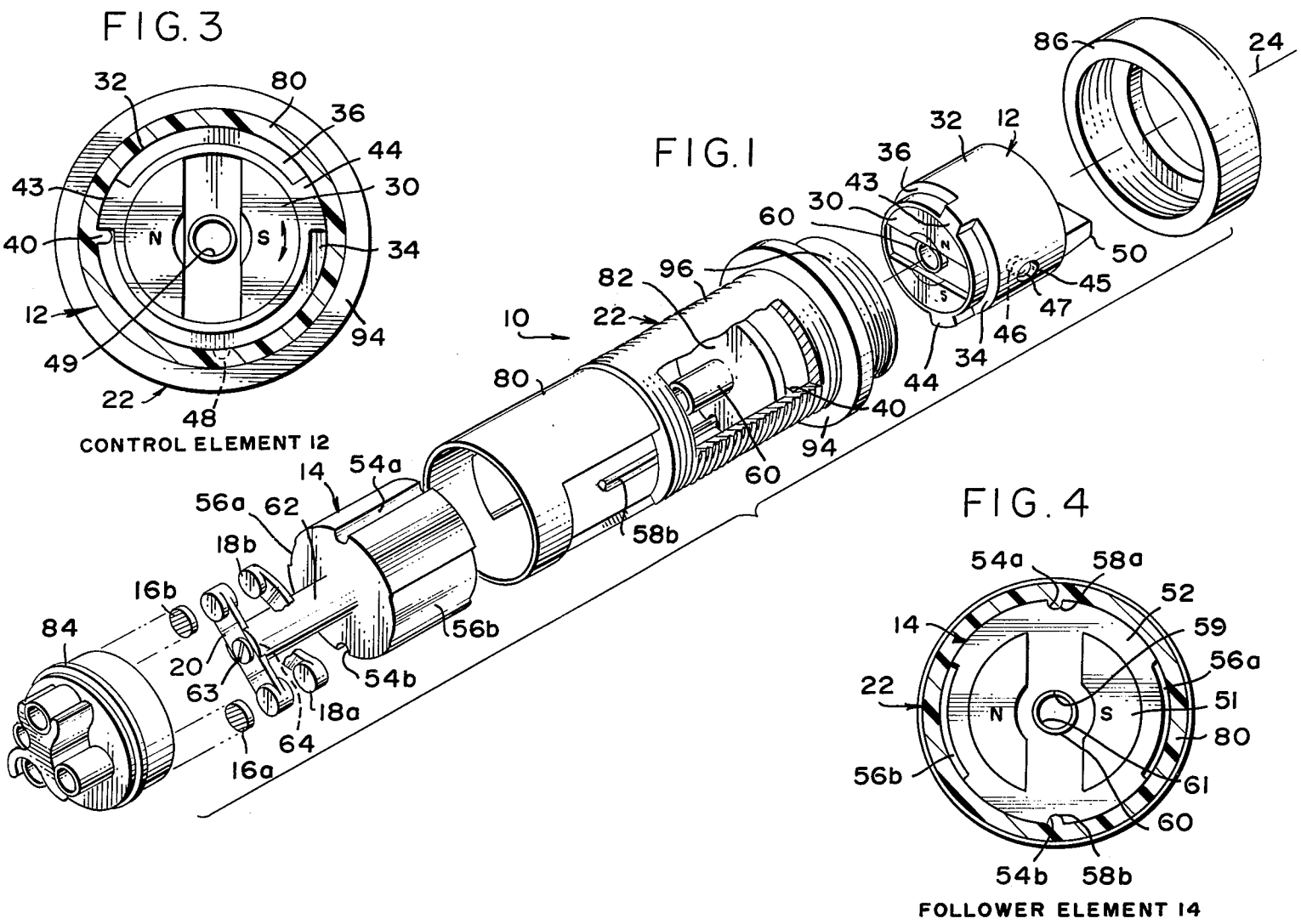
FIG. 1 is an exploded perspective view of a sealed magnetic switch in accordance with the invention.
FIG. 3 is an end view of a magnetic control element shown in FIG. 1, taken from a magnetic pole face end.
FIG. 4 is an end view of a magnetic follower element shown in FIG. 1, taken from a magnetic pole face end.

As shown in FIGS. 1 and 2 a sealed, magnetically operated switch 10 in accordance with the invention includes a control permanent magnet element 12, a follower permanent magnet element 14, electrical contact pairs 16*a*, 16*b* and 18*a* and 18*b*, a conductive bar 20 for selectively closing the contact pairs 16, 18 which is coupled for motion with follower magnet element 14, and a housing 22. The magnet elements 12, 14 and housing 22 are generally cylindrical in shape and are disposed about a central axis 24.

The permanent magnet element 12, which is a multipurpose universal magnet element includes a U-shaped or C-shaped permanent magnet 30, has a plurality of coplanar pole faces and in the present example, has north and south pole faces designated N and S respectively and is molded within an outer cylindrical plastic carrier shell 32. Though the magnet elements 12, 14 are shown as having only one pair of magnetic poles each, it will be appreciated that the number of opposing pole pairs may be increased if desired. As further shown in FIG. 3, the shell 32 of magnet element 12 has two circumferentially extending peripheral grooves 34, 36 adjacent the face thereof. A tab 40 extends radially inward from the periphery of a control element chamber of housing 22 to engage one of the grooves 34, 36 and limit the angle through which control element 12 is free to rotate. The grooves 34, 36 are separated by limiting regions 43, 44 which contain no groove and define the rotational limits of grooves 34, 36. Groove 34 permits an included angle of rotation of approximately 200° while groove 36 permits an included angle of rotation of approximately 90°. Thus, by selectively aligning tab 40 with groove 34 or groove 36, the included angle of rotation of control element 12 may be selectively limited to either 200° or 90° respectively. In this way the identical control element 12 may be utilized in a variety of switch arrangements. A diametrically extending bore 45 in the cylindrical side wall of control element 12 may receive a helical compression spring 46 forcing a ball 47 radially outward. One or more shallow cavities 48 may be formed in the inner cylindrical side wall of housing 22 to form a detent when ball 47 is rotated into detent 48. A central, axially extending bore 49 extends part way into control element 12 from the pole face end thereof with a suitable diameter and depth for receiving and guiding a helical compression spring.

In the arrangement shown in FIG. 1, the tab 40 and rotational limits on follower element 14 are coordinated such that when element 12 is oriented at the approximate center of the 90° rotational angle thereof with tab 40 engaging the center of groove 36, the facing poles of element 12 and element 14 are rotated 90° from one another and the axial forces between the two elements 12, 14 are substantially neutral. Then, as control element 12 is rotated by manipulating a handle 50 on an end thereof opposite the magnetic pole faces, to rotate magnet 30 toward similarly poled alignment with the magnet of element 14 while holding follower element 14 rotationally fixed, repulsive magnetic forces are developed and element 14 is moved axially toward a spaced-apart position relative to control element 12 with conductive path bar 20 engaging and closing contacts 16*a* and 16*b*. If control element 12 is rotated in the opposite direction toward opposite polarity alignment of poles of magnet 30 with the magnetic poles of follower element 14, follower element 14 is moved axially toward a proximate position relative to control element 12 until the conductive path provided by bar 20 engages and closes contacts 18*a*, 18*b*.

As further shown in FIG. 4, the follower magnetic element 14 includes a U-shaped or C-shaped permanent magnet 51 having a plurality of coplanar pole faces and is molded into a cylindrical plastic shell 52. The cylindrical periphery of element 14 contains two pairs of axially extending diametrically opposite grooves 54*a*, 54*b* and 56*a* and 56*b*. A pair of tabs 58*a*, 58*b* extend radially inward a short distance from the inside periphery of a follower element chamber of housing 22 in the vicinity of follower element 14 to engage a pair of grooves 54 and 56, depending upon the orientation of the follower element 14 during assembly. In the arrangement shown in FIGS. 1 and 2 follower element 14 is assembled with tabs 58 engaging small grooves 54 to prevent rotation of follower element 14 while allowing axial motion. When follower element 14 is assembled with tabs 58 engaging grooves 56, follower element 14 is free to rotate through an included angle of approximately 60° and is also free to move axially. The grooves 54 are peripherally located such that a diameter extending therebetween passes symmetrically between the two north and south poles labeled "N" and "S" respectively of magnet 51 to provide the required axially neutral force when control element 12 is disposed at the center of the rotational angle provided by small angle groove 36. The center of peripheral grooves 56*a* and 56*b* are rotated approximately 90° relative to grooves 54*a* and 54*b* respectively. A central, axially extending bore 59 is formed in the pole face end of follower element 14 to matingly receive an axially extending tube-shaped projection 60 of housing 22. Tube-shaped projection 60 has an axially extending bore 61 therein of a suitable diameter and depth for receiving a helical spring which may be compressed between follower element 14 and housing 22.

An elongated, small diameter cylindrical support member 62 (FIG. 5) extends axially out of a face of follower element 14 opposite the magnetic pole faces "N" and "S" of magnet 50 integral with the molded plastic carrier 52. The conductive bar 20 is secured to an end of member 62 by a nail or stud 63 passing through a central aperture in bar 20 to engage the member 62. Compression spring elements 65, 66 are disposed between bar 20 and member 62 and between an enlarged head of stud 63 and bar 20 respectively to insure proper contact of bar 20 with electrical contacts 16 and 18 without need for high precision machining.

The housing 22 includes a generally cylindrical wall 80, which extends axially from approximately the contacts 16 to an end of control element 12 adjacent handle 50, a radially extending sealing wall 82, a radially extending switch closure seal 84 and a partially radially extending restraint element 86 which threadingly engages wall 80 at an end adjacent control element 12. The thin, disk-shaped sealing wall 82 is integral with cylindrical wall 80 and completely isolates a control chamber 88 which receives control element 12 from a sealed follower chamber 90 which receives follower element 14, and switch contacts 16*a*, 16*b*. An opposite end of follower chamber 90 is sealed by radially extending seal 84 which sealingly engages cylindrical wall 80. Sealed conductive paths 92 may be advantageously provided through seal 84 to provide external connection to switch contacts 16 and 18. Restraint element 86 threadingly engages the outer periphery of cylindrical wall 80 to constrain control element 12 to the cavity 88. A central, axially extending aperture through restraint element 86 receives handle 50 to permit operator manipulation of the switch. A disk-shaped flange 94 extends radially outward from the periphery of cylindrical wall 80 to permit alignment of switch 10 with a wall of a panel wall 87 on which it is to be mounted and threads 96 are provided on the outer circumference of wall 80 to receive restraint element 86 as well as a nut 97 for fastening the switch 10 to a panel wall 97. A convexity 98 appears along central axis 24 integral with sealing wall 82 on the control chamber 88 side thereof for matingly receiving and guiding a helical compression spring which may be employed for selected switch configurations.

The operation of switch 10 shown in FIGS. 1–4 is as follows. With control element 12 disposed with the tab 40 engaging small peripheral groove 36 at approximately the center of the angle of rotation of element 12, the attractive and repulsive forces between the two magnets 30 and 51 are approximately equal and the position of follower element 14 is indeterminate in that it will probably remain at substantially its last switching position. If control element 12 is now rotated towards similar polarity alignment of north and south poles of magnets 30 and 51, the repulsive forces will begin to exceed the attractive forces and follower element 14 will move axially to a spaced-apart position relative to separator wall 82 and control element 12 at which conductive bar 20 engages and closes contacts 16*a* and 16*b*. If the control element 12 is then rotated in the opposite direction, as the north and south magnetic poles of magnets 30 and 51 begin to come into opposite polarity alignment, the attractive forces begin to exceed the repulsive forces. These attractive forces cause follower element 14 to move axially toward a proximate position relative to sealing wall 82 and control element 12 at which conductive bar 20 engages and closes contacts 18*a* and 18*b*. The follower element 14 is thus controlled to selectively close contacts 16 or 18 in response to the rotational position of control element 12 while remaining completely sealed within chamber 90. Chamber 90 may be evacuated or filled with an inert gas as desired prior to sealing.

As shown in FIG. 5, the switch components may be alternatively configured to create an alternate single throw, single pole double break switch 100. The permanent magnet element 12 is oriented within housing 22 with tab 40 engaging large peripheral groove 34 and follower element 14 is oriented with detents 58*a* and 58*b* engaging longitudinally extending grooves 56*b* and 56*a* respectively. This arrangement places magnets 30 and 51 in oppositely poled alignment when both control element 12 and follower element 14 are at approximately the center of their respective rotational limits.

The switch contact arrangement is slightly different in that contacts 18*a* and 18*b* are replaced by contacts 102*a* and 102*b* which lie in the same plane as contacts 16 but are rotated approximately 90° therefrom. Conductive bar 20 is oriented such that bar 20 is disposed opposite contacts 16 and 16*b* when follower element 14 is rotated counterclockwise until detent 58*a* engages a limit 104*a* in longitudinal 8c groove 56*b*. When follower element 14 is rotated clockwise until follower element 58*a* engages a limit 104*b* of grooves 56*b* conductive bar 20 is disposed opposite contacts 102. Neither set of contacts is closed until follower element 14 is moved to a spaced-apart position relative to sealing wall 18 and control element 12.

As shown in FIGS. 6 and 7, limit or spacer elements 106 may be disposed between adjacent pairs of contacts such as pair 102*a* and 16*a* or pair 16*a* and 102*b*. The spacer element 106 prevents the conductive bar 20 from becoming positioned and perhaps locked between sets of contacts as a result of any accelerations that may be externally applied to switch 100.

Operation of the switch 100 may be best understood beginning with both the control element 12 and follower element 14 disposed at the approximate midpoint of their rotational limits as illustrated by magnets 30 and 51 in FIG. 8. The north and south poles of magnet 51 of follower element 14 are in opposite polarity alignment with the south and north poles of magnet 30 of control element 12 respectively. While the magnet 30 is shown in FIGS. 8–10 as having a circumference greater than magnet 51, it should be recognized that the magnets are depicted in this manner for convenience of illustration and that in general the magnets 30 and 51 may be and probably would be identical. It should also be recognized that while the magnets 30 and 51 are illustrated as containing two poles each, a different number of poles may be provided as desired. An increase in the number of poles would tend to decrease the required rotational angles. With the magnets oriented as shown in FIG. 8, follower element 14 is attracted to control element 12 and the magnetic forces tend to maintain the two elements 12, 14 in oppositely poled magnetic alignment. If the control element is rotated counterclockwise, the follower element 14 will rotate therewtih until the detent 58*a* engages limit 104*a* of groove 56*b* as illustrated in FIG. 9. At this orientation, the conductive bar 20 is oriented opposite electrical contacts 16*a* and 16*b* but the contacts cannot be actually closed so long as the follower element 14 is positioned proximate the sealing wall 82 and control element 12. Because the limits of the rotational angle for control element 12 are much greater than those for follower element 14, control element 12 may continue to rotate counterclockwise for approximately an additional 90° or more.

FIG. 10 illustrates the relative position of the magnets 30 and 51 after control element 12 is rotated an additional 90° beyond the limit 104*a* of follower element 14. In this position, 90° rotation of magnet 51 in a counterclockwise direction is required to bring the two magnets into oppositely poled alignment while 270° of rotation of follower element 14 in the clockwise direction is required to attain oppositely poled alignment. Thus, follower element 14 is strongly attracted toward counterclockwise rotation and magnetic forces hold the limit 104*a* of groove 56*b* in contact with detent 58*a* of housing 22. Conductive bar 20 is thus maintained in alignment with electrical contacts 16*a* and 16*b*. However, in the axial direction the magnetic forces are neutral because each pole of magnet 30 of the control element 12 is aligned opposite symmetrically equal areas of similar and opposite poles of magnet 51 in follower element 14. Thus, any continued rotation of control element 12 in the counterclockwise direction will tend to induce repulsive axial forces while maintaining attractive rotational forces and conductive bar 20 will be driven into contact with contacts 16*a* and 16*b* as follower element 14 is repulsed to a spaced-apart position. Alternatively, the rotational limits of control element 12 may be reduced somewhat by placing a compression spring 108 within the hollow center of member 60 to resiliently bias follower element 14 toward a spaced-apart position. The axial forces on follower element 14 will thus become neutralized while the control element 12 is disposed at a rotational position at which attractive forces still remain between the magnets 30 and 51. Thus, as control element 12 rotates to the position shown in FIG. 10 where the magnetic forces are axially neutral, follower element 14 will be forced to a spaced-apart position to close contacts 16*a* and 16*b* at the relative orientations shown in FIG. 10. If the control element 12 is now rotated in a clockwise direction the operation of switch 100 is similar except that the follower element 14 will assume a spaced-apart position while control bar 20 is oriented to close switch contacts 102*a* and 102*b* while detent 58*a* engages limit 104*b* of groove 56*b*.

As control element 12 begins rotating in the clockwise direction attractive forces between the magnets 30 and 51 begin to increase as they come into oppositely poled alignment and until follower element 14 is attracted to a proximate position at which none of the switch contacts 16, 102 are closed. Follower element 14 then remains in the proximate position and begins to rotate as it follows the rotational position of control element 12 until detent 58 engages limit 104*b* to prevent further clockwise rotation of follower element 14. As control element 12 then continues to rotate approximately 90° in the clockwise direction, rotational attraction is continued to maintain detent 58*a* in contact with limit 104*b* but axial attraction decreases until follower element 14 experiences axial forces tending to move it toward a spaced-apart position to close switch contacts 102*a* and 102*b*.

Switch operation as described above may be accomplished with less than 360° of rotation of control element 12 and a spring may be employed to resiliently bias follower element 14 toward a spaced-apart position and increase contact closure force. However, a rotational angle of 360° plus the rotational angle of follower element 14 is required for control element 12 if maximum switch closure magnetic forces are to be realized. This large rotational angle can be greatly reduced with alternative mode of switch operation. In the alternative mode the magnetic elements 12, 14 are disposed for similarly poled repulsive alignment when each is at the midpoint of its range of rotational motion. This is an unstable position which normally does not occur during switch operation.

To understand this alternative mode of switch operation assume that follower element 14 is at a clockwise rotational limit at a spaced-apart axial position. As control element 12 is rotated clockwise toward opposite polarity alignment axial repulsive forces increase and clockwise rotational forces decrease. Maximum contact force occurs at opposite polarity alignment. Then, if control element 12 is rotated clockwise, follower element 14 begins to experience counterclockwise forces and the repulsive forces decrease until contact pressure decreases to the point where follower element 14 begins a counterclockwise rotation. If follower element 14 has a rotational freedom of about 90°, the axial forces will become at first less repulsive and then attractive as the follower element 14 rotates to its counterclockwise limit. If control element 12 is now rotated counterclockwise, axial repulsive forces are increased while follower element 14 remains at the counterclockwise limit until similar polarity repulsive alignment is attained. Continued clockwise control element 12 rotation will then cause follower element to rotate to the clockwise limit at a proximate axial position. More than 360° of rotation for the control element 12 is thus avoided by rotating the control element 12 toward a first limit to align the follower element 14 opposite a given set of contacts at a given limit and then rotating the control element 12 back part way toward the opposite limit to close the contacts.

The switch contacts may also be disposed for closure when follower element 14 is at a proximate rather than a spaced-apart position. Switch operation is then the mirror image of operation for the spaced-apart contact positions. It is also possible to place switch contacts to have a contact set closed when the follower element 14 is at both spaced-apart and proximate positions.

A pair of cavities like cavity 48 (see FIG. 3) may be formed in housing 22 to form detents for positioning control element 12 in similar polarity repulsive alignment of the control and follower elements 12, 14 when follower element 14 is at either its clockwise or counterclockwise rotational limit. For the first described mode of operation control element 12 must be permitted to rotate through an angle greater than 360° or else a resilient bias must be employed to increase contact force. For the alternate mode of operation rotation may be limited to 180° or less.

Figure 11:
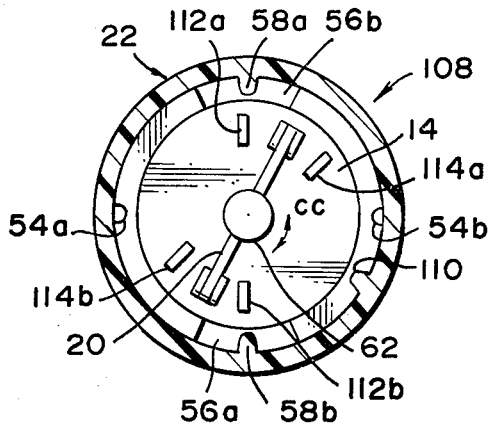
FIG. 11 is an end view, partly broken away, of an alternative arrangement of a sealed magnetic switch is accordance with the invention.

In still another arrangement shown in FIG. 11 the electrical contact arrangement is modified slightly and the follower element 14 is oriented with detent 58*a* engaging large groove 56*b* and detent 58*b* engaging large groove 56*a*. An additional detent 110 extends radially inward from housing 22 at the rearward end of the large cylindrical portion of follower element 14 opposite sealing wall 82 to prevent substantial axial motion of follower element 14. Control element 12 is disposed with detent 40 engaging small rotational angle groove 34 to thereby place the magnets 30 and 51 into similarly poled alignment when both control element 12 and follower element 14 are approximately at the center of their respective angles of rotation. This arrangement tends to create both rotational and axial repulsion between the two magnets, but axial motion is limited by detent 110. Thus, as control element 12 is rotated counterclockwise, follower element 14 is rotationally repulsed and rotated clockwise toward its rotational limit. The switch 108 is provided with contact pairs 112*a*, 112*b* and 114*a*, 114*b*. As conductive bar 20 rotates with follower element 14 and as element 14 approaches its clockwise limit, bar 20 engages and closes switch contacts 114*a* and 114*b* to prevent further rotation of follower element 14. The repulsive rotational forces between control element 12 and follower element 14 maintain contacts 114 closed while control element 12 is rotationally positioned at its counterclockwise limit. If control element 12 is now rotated clockwise toward its clockwise limit, the poles of the magnets 30 and 51 again become similarly aligned and repulsive rotational forces are developed to rotate follower element 14 and conductive bar 20 toward their counterclockwise limit at which bar 20 engages and closes switch contacts 112*a* and 112*b*.

Figure 12:
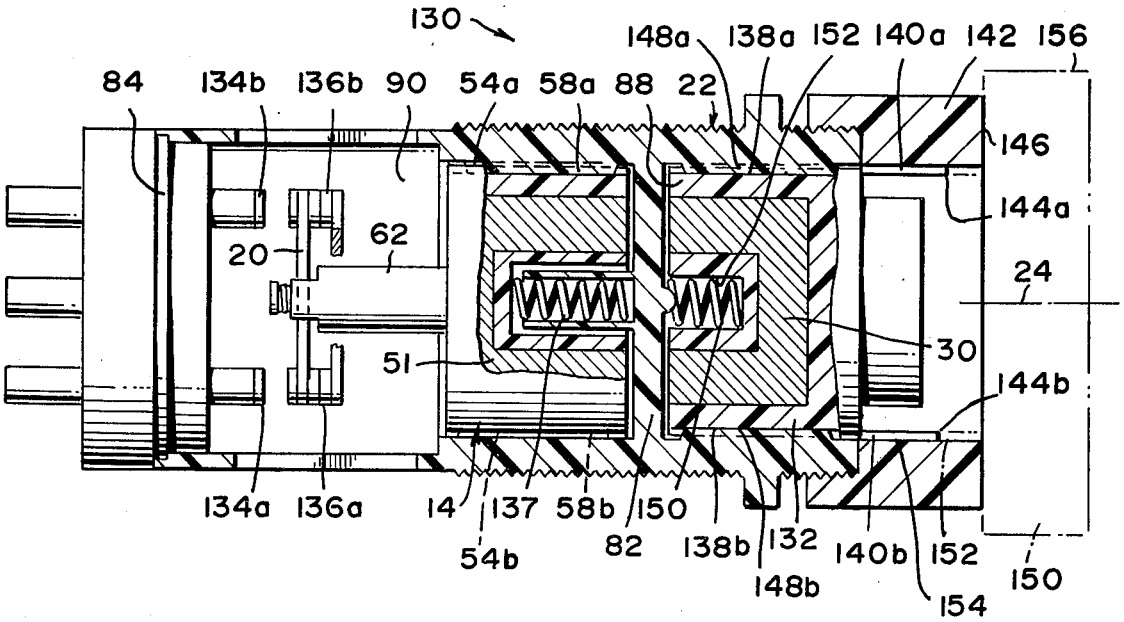
FIG. 12 is a sectional plan view taken through a diametric plane of still another alternative arrangement of a sealed magnetic switch in accordance with the invention.

In still another arrangement of a sealed magnetic switch in accordance with the invention shown in FIG. 12, a pushbutton switch 130 includes a control magnetic element 132, a follower magnetic element 14 coupled to carry a conductive bar 20, and pairs of switch contacts 134*a*, 134*b* disposed to be closed by conductive bar 20 when follower element 14 is at a spaced-apart position and contacts 136*a*, 136*b* disposed for closure by conductive bar 20 when follower 14 is at a proximate position. A housing 22 which may be the same as housing 22 in FIG. 2, defines a control element chamber 88 at one end thereof and a sealed follower and control chamber 90 containing switch contacts at the opposite end thereof which is defined between an intermediate sealing wall 82 and a contact closure element 84 through which the conductive paths for switch contacts 134 and 136 pass. Follower element 14 is oriented within the sealed follower and contact chamber 90 with detents 58*a* and 58*b* engaging narrow angle longitudinally extending grooves 54*a* and 54*b* respectively. Follower element 14 is thus free to move axially but may not rotate. A spring element 137 resiliently biases follower element 14 toward a spaced-apart position tending to close switch contacts 134*a* and 134*b*.

Pushbutton switch control element 132 is disposed within chamber 88 with a magnet 30 molded therein in a manner similar to the manner in which magnet 30 is molded within control element 12. Control element 132 is oriented for axial translation but not rotational motion with the poles of magnet 30 therein in opposite polarity alignment with the poles of magnet 51 within follower element 14. The housing 22 includes a pair of diametrically opposite grooves 138*a*, 138*b* which extend axially throughout substantially the entire length of chamber 88 and mate with axially extending grooves 140*a*, 140*b* of a pushbutton retainer cap 142 which threadingly engages the outer circumference of housing 22. Grooves 140*a*, 140*b* terminate at limits 144*a*, 144*b* respectively adjacent, but spaced apart from an annular end surface 146 of cap 142. Lands 148*a*, 148*b* extend radially outward a short distance from the cylindrical outer surface of control element 132 to matingly engage the grooves 138, 140. The length of the lands 148*a*, 148*b* are selected such that when control element 132 is in a depressed position proximate the sealing wall 82, the lands 148 are disposed entirely within the limits of housing 22 and cap 142 may be screwed onto housing 22. After screwing cap 142 onto housing 22, the grooves 140 are aligned with grooves 138 and pushbutton control element 132 is provided with an axial translation path between an extended position at which it is spaced apart from sealing wall 82 and a depressed position at which it is proximate sealing wall 82. At the spaced-apart position lands 148 engage both grooves 138 and 140 to prevent relative rotational motion between cap 142 and housing 22 actively prevent cap 142 from being unscrewed. A spring element 150 is disposed within a central axial bore 152 of pushbutton control element 132 and presses against sealing wall 82 to resiliently bias control element 132 toward an extended position. The spring constant of spring 150 is sufficient to overcome attractive magnetic forces regardless of the position of follower element 14 and force pushbutton control element 132 toward an extended position in the absence of an external force.

In operation, pushbutton control element 132 is normally in an extended position (not shown) under bias of spring 150 and follower element 14 is normally in a spaced-apart position (not shown) in response to the bias of spring 136 with conductive bar 20 closing contacts 134*a*, 134*b*. The spring constant of spring 136 is selected with regard to the attractive forces of magnets 30 and 51, as well as the axial translation distances of pushbutton control element 132 and follower element 14 to permit the repulsive force of spring 136 to prevail and bias follower element 14 toward a spaced-apart position when control element 132 is at an extended position while permitting the magnetic forces to overcome the bias of spring 137 and attract follower element 14 to a proximate position at which conductive bar 20 closes switch contacts 136*a*, 136*b* when pushbutton control element 132 is at a depressed position. Control element 132 may typically have an axial travel distance on the order of ¼ inches or greater while follower element 14 may have typical axial travel distance on the order of 0.05 inches or less. This substantial difference in the range of motions for the control element 132 and follower element 14 with follower element 14 having the shorter travel distance increases the acceptable tolerances on the attractive magnetic forces and spring constant of spring 137 by substantially increasing the difference between the attractive magnetic forces when pushbutton control element 132 is at extended and depressed positions.

With a slight modification, pushbutton switch 130 may be converted to a push-pull switch by slightly modifying pushbutton control element 132 by adding a handle 150 which is indicated by dotted lines. Handle 150 includes a frictional cylindrical surface 152 which frictionally engages an interior cylindrical surface 154 of cap 142 to tend to maintain the control element 132 at an axial position in the absence of external forces. An enlarged head or gripping portion 156 has a diameter slightly greater than the outside diameter of cap 142 to permit the handle 150 to be easily grasped. By manipulation of handle 150, the control element 132 may be selectively positioned at extended or depressed axial positions and the operation of the switch remains substantially the same as for the pushbutton arrangement of switch 130 as described above.

It is thus apparent that a few universal switch components may be selectively assembled in different ways to produce a large variety of different switch configurations. The generally cylindrical housing 22 provides axially spaced and aligned control element and sealed follower chamber 88, 90 respectively which are separated by a sealing wall 82. The follower element 14 includes a permanent magnet and has a generally cylindrical outer circumference which extends between a disk-shaped end having magnetic pole faces in close proximity thereto and an opposite end which is coupled to provide an electrical conductive path which selectively opens and closes switch contacts in accordance with the position of the follower element 14 relative to the housing 22. Axially extending grooves with different circumferential widths are provided in the outer cylindrical surface of follower element 14 for selective engagement with a detent affixed to the housing 22 to provide a selected range of rotational freedom for follower element 14. Similarly, the switch control element for disposition within the switch control chamber 88 includes a permanent magnet and has a cylindrical outer surface extending between a disk-shaped end having magnetic pole faces in close proximity thereto and an opposite end which is coupled to a handle. Circumferentially extending grooves of different circumferential lengths are provided at the intersection of the disk-shaped surface and the outer cylindrical surface for selective engagement with a detent affixed to housing 22 for selective provision of different ranges of rotational freedom for the control element in accordance with the manner of assembly. A slightly different pushbutton control element having axially extending ridges in lieu of the peripheral grooves may be disposed within the control element chamber 88 with the ridges in mating relationship with axially extending grooves in the circumferential wall of chamber 88 to provide a pushbutton or push-pull switch in accordance with the invention.

While there have been shown and described above various arrangement of sealed, magnetic switches in accordance with the invention for the purpose of enabling a person of ordinary skill in the art to make and use the invention, it will be appreciated that the invention is not limited thereto. Accordingly, any modifications, variations or equivalent arrangements within the scope of the attached claims should be considered to be within the scope of the invention.

What is claimed is:

1. A sealed rotary switch comprising:

first and second permanent magnets disposed along an axis with pole faces in spaced-apart opposed relationship; a housing sealingly enclosing the second permanent magnet and having a nonmagnetic wall interposed between the mating pole faces of the first and second magnets; a first pair of spaced-apart contacts sealed within the housing with electrical connection through the housing; a bar sealed within the housing; a second pair of contacts mounted on the bar in spaced-apart relationship for selective respective engagement with the first pair of contacts, the second pair of contacts being electrically interconnected; and a spring connected to provide resilient coupling between the second magnet and the bar at a point therealong midway between the second pair of contacts; the second magnet being movable to position the bar to selectively open and close the set of electrical contacts in response to predetermined motion of the first magnet and the spring being coupled to exert a force on the bar when the first and second pairs of contacts are closed which force tends to maintain said contacts in a closed relationship notwithstanding motion of the second magnet.

2. The switch according to claim 1 above, wherein the spring is a coil spring.

3. The switch according to claim 1 above, wherein the first magnet is rotatable about the axis at a fixed axial position.

4. The switch according to claim 3 above, wherein the second magnet is rotationally fixed and axially slides between alternatively spaced and proximate positions relative to the first magnet as the facing poles become similarly and oppositely poled respectively as the first magnet rotates about the axis.

5. The switch according to claim 3 above, further comprising means for limiting the rotation of the first magnet to a first angle of rotation, means for limiting the rotation of the second magnet between opposite limits of a second angle of rotation less than the first angle of rotation, the magnets having poles in aligned opposing relationship when each is disposed approximately at the midpoint of its angle of rotation.

6. The switch according to claim 3 above, further comprising means for preventing rotation of the second magnet, the second magnet being axially movable between spaced-apart and proximate axial positions relative to the first magnet as the first magnet rotates about the axis, and wherein the set of electrical contacts includes a first pair of contacts coupled to be closed when the second magnet is at a spaced-apart axial position and a second pair of contacts coupled to be closed when the second magnet is at a proximate axial position.

7. The switch according to claim 6 above, wherein the first pair of contacts includes first and second contacts lying in a first plane perpendicular to the axis and on a line extending through the axis, wherein the second pair of contacts includes third and fourth contacts lying in a second plane perpendicular to the axis between the first plane and the first magnet and being disposed opposite the first and second contacts respectively, and further comprising a conductive path coupled for axial movement with the second magnet, the conductive path being disposed to close the first and second contacts when the second magnet is in a spaced-apart axial position and to close the third and fourth contacts when the second magnet is in a proximate axial position.

8. The switch according to claim 3 above, further comprising means for maintaining the second magnet at a fixed axial position and means for limiting angular rotation of the second magnet to first and second limits having a given angle of rotation between them, the second magnet having coupled for rotation therewith a conductive path which is disposed to close a first pair of contacts of the set of electrical contacts only when the second magnet is rotated to a first limit.

9. The switch according to claim 8 above, further comprising means for limiting angular rotation of the first magnet to third and fourth limits having an angle of rotation therebetween which is greater than the given angle of the second magnets, the poles of the first and second magnets having similar poles in repulsive aligned opposing relationship when both the first and second magnets are oriented approximately at the midpoints of their respective angles of rotation.

10. The switch according to claim 1 above, further comprising means for inhibiting rotation of the first magnet and constraining axial motion of the first magnet to first and second axially spaced limits, the first magnet having pole faces thereof proximate the interposed nonmagnetic wall at the first limit and spaced apart from said wall at the second limit; a first resilient element coupled to forcibly bias the first magnet toward the second limit; means for inhibiting rotation of the second magnet with the poles thereof disposed in opposite polarity aligned opposing relationship to the poles of the first magnet and constraining axial motion of the second magnet to third and fourth axially spaced limits, the second magnet having pole faces thereof axially spaced apart from said wall at the third limit and proximate said wall at the fourth limit; and a second resilient element coupled to bias the second magnet toward the third limit with less force than that of the first biasing element, relationships of the first and second biasing elements, attractive forces of the first and second magnets and the first through fourth limits being selected such that (1) the force of the first biasing element is sufficient to overcome the attractive forces of the magnets regardless of the axial positions thereof; (2) when the first magnet is disposed at the first limit the attractive forces of the magnets are sufficient to overcome the force of the second resilient element regardless of second magnet axial position and (3) when the first magnet is at the second limit the attractive forces of the magnets are insufficient to overcome the force of the second resilient element regardless of the axial position of the second magnet.

11. A universal sealed magnetic switch comprising:

a housing defining first and second chambers disposed along an axis, the first chamber having an axially extending groove defined in an interior wall surface thereof and a detent and the second chamber being sealed and having a detent;

a set of switch contacts disposed within the second chamber, each contact having electrical communication through the housing;

a switch control element including a permanent magnet and having first and second circumferentially extending grooves of different lengths disposed within the first chamber with the detent of the first chamber engaging a selected one of the control element grooves to provide a desired magnetic orientation and range of rotational motion for the switch control element; and a switch follower element including a permanent magnet and havivg first and second axially extending peripheral grooves of different circumferential extent disposed within the second chamber with a second chamber detent engaging a selected follower element groove to provide a desired range of rotational freedom and relative magnetic pole orientations between the magnets of the control and follower elements, the follower element including a conductive bar having opposite ends disposed to selectively engage and close a pair of said switch contacts in accordance with the position of the switch follower element and a spring resiliently coupling the bar to the permanent magnet of the switch follower, the spring being coupled to the bar at a midpoint thereof.

12. The universal sealed magnetic switch in accordance with claim 11 above, wherein the housing defines first and second chambers which are generally cylindrical in shape and includes a thin, disk-shaped sealing wall disposed between the first and second chambers.

13. The universal sealed magnetic switch according to claim 11 above, wherein the detent within the first chamber is a small tab adjacent an intersection of a cylindrical wall and the disk-shaped sealing wall and the detent of the second chamber is in axially extending land which extends radially inward from a cylindrical interior wall surface of the second chamber.

14. The universal sealed magnetic switch according to claim 11 above, wherein the switch control includes permanent magnetic means having a plurality of pole faces and the control element includes permanent magnet means having a plurality of pole faces in opposed, facing relationship to the pole faces of the control element.

15. The switch according to claim 1 above, further comprising a second spring coupled between the bar on a side thereof opposite the first mentioned spring and the second magnet and exerting a force on the bar which opposes the force of the first mentioned spring to maintain the bar resiliently positioned between the first mentioned and second springs.

16. The switch according to claim 15 above, wherein the first mentioned and second springs are coil springs maintained in compression.

17. The switch according to claim 1 above, wherein the bar is free to rotate somewhat about the point where the spring is coupled to the bar to tend to equalize the force between each of the contacts when the switch is closed.

18. The switch according to claim 17 above, wherein the bar is a conductor providing the conductive path between the second pair of switch contacts.

* * * * *

UNITED STATES PATENT AND TRADEMARK OFFICE

CERTIFICATE OF CORRECTION

PATENT NO. : 4,027,278

DATED : May 31, 1977

INVENTOR(S) : Gabriel M. Giannini

It is certified that error appears in the above-identified patent and that said Letters Patent are hereby corrected as shown below:

Column 4, line 29, after "switch", "is" should read --in--. Column 6, line 14, "65" should read --64--; line 47, "97" should read --87--. Column 7, line 31, after "longitudinal" and before "groove", delete "8c". Column 13, line 19, "alternatively" should read --alternately--. Column 14, line 57, "havivg" should read --having--. Column 15, line 19, "magnetic" should read --magnet--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*